United States Patent [19]

Demoures et al.

[11] 3,936,480

[45] Feb. 3, 1976

[54] ADDITIVES FOR IMPROVING THE DISPERSING PROPERTIES OF LUBRICATING OIL

[75] Inventors: Bernard Demoures, Puteaux; Daniel Llauro, Crepieux-le-Pape; Francois Giolito, Lyon, all of France

[73] Assignee: Rhone-Progil, Paris, France

[22] Filed: Nov. 16, 1972

[21] Appl. No.: 307,062

Related U.S. Application Data

[63] Continuation-in-part of Ser. No. 267,048, June 28, 1972, Pat. No. 3,862,981.

[30] Foreign Application Priority Data

July 8, 1971 France ..... 71.26025
Nov. 17, 1971 France ..... 71.41972

[52] U.S. Cl. ..... 260/404.5; 44/71; 252/51.5 A; 260/286 R; 260/295 R

[51] Int. Cl.[2] ..... C10L 1/22; C10M 3/26

[58] Field of Search ..... 260/404.5, 404; 252/51.5 A

[56] References Cited

UNITED STATES PATENTS

| | | | |
|---|---|---|---|
| 2,491,478 | 12/1949 | Cook et al. | 260/404 |
| 2,596,985 | 5/1952 | Cook et al. | 260/404.5 X |
| 2,908,647 | 10/1959 | Vaughn | 260/404.5 X |
| 2,996,464 | 8/1961 | Schroeder et al. | 260/404.5 X |
| 3,172,892 | 3/1965 | Suer et al. | 260/51.5 A X |
| 3,184,474 | 5/1965 | Catto et al. | 260/404.5 X |
| 3,278,550 | 10/1966 | Norman et al. | 260/51.5 A X |
| 3,381,022 | 4/1968 | Suer | 260/404.8 |
| 3,382,261 | 5/1968 | Kittredge et al. | 260/404.5 |
| 3,522,179 | 7/1970 | Suer | 252/51.5 A |
| 3,576,743 | 4/1971 | Widmer et al. | 252/51.5 A |
| 3,620,977 | 11/1971 | Petaluma et al. | 252/51.5 A |
| 3,668,236 | 6/1972 | Cyba | 252/51.5 A |
| 3,720,615 | 3/1973 | Izumi et al. | 252/51.5 A |

*Primary Examiner*—Ethel G. Love

[57] ABSTRACT

New lubricating oil additives are provided comprising the reaction product of a hydroxy compound, such as an alcohol or hydroxyaromatic compound, with an aliphatic chain substituted-carboxylic anhydride, acid, chloride, or ester, which aliphatic chain substituent is substantially saturated and contains at least about 30 carbon atoms, said reaction product being neutralized with an ashless basic compound, so that the final product or additive contains at least about 0.9%, up to about 2.5%, by weight of nitrogen. Lubricating oils, fuel oils, and carburants containing the new additives have excellent detergent, dispersing and anti-rust properties.

7 Claims, No Drawings

ADDITIVES FOR IMPROVING THE DISPERSING PROPERTIES OF LUBRICATING OIL

This application is a continuation-in-part of our copending application, Ser. No. 267,048, filed June 28, 1972, now U.S. Pat. No. 3,862,981.

BACKGROUND OF THE INVENTION

The present invention relates to new lubricating oil additives which impart to lubricating oils good detergent, dispersing and anti-rust properties. This invention relates also to lubricating oils and to fuels and carburants containing said additives.

There are known to the prior art, additives for lubricating oils which consist of derivatives of carboxylic acids substituted with slightly unsaturated hydrocarbons. This class of additives, which has been known for some years, was an important development to the lubricating oil art. They consist mainly of reaction products of carboxylic acid acylating agents, substituted with a fairly saturated hydrocarbon radical containing an aliphatic chain of at least 30 carbon atoms, preferably 50 carbon atoms, with amines or alcohols.

Lubricating oil additives in the nature of acylated amines produced from the reaction of substituted carboxylic acid acylation agents with amines, such as disclosed in U.S. Pat. No. 3,172,892, granted Mar. 9, 1965, are known for their desirable dispersing properties, especially with regard to sludge. A "sludge" is the product formed in a motor crank case when the temperature of the lubricating agent in the crank case is alternately low and high or maintained at a low temperature in a continuous way. This last condition frequently occurs in urban traffic in what is frequently referred to as "door to door" travel at low speeds. Low operating temperatures favor water formation and accumulation within the lubricating agent. The combination of condensed water, of curburant and lubricating agent, decomposition products, and of oil forms the sludge. This sludge, which is not readily dispersed, may be damaging to the operation of a motor.

Lubricating agent additives in the form of esters resulting from the reaction of the same foregoing acylation agents with alcohols or phenols are efficient anti-rust agents and reasonably good detergents. Products of this nature are disclosed in U.S. Pat. No. 3,381,022, granted Apr. 30, 1968. The dispersing action of these additives is, however, limited by their relatively low thermal stability, by their lack of resistance to hydrolysis, and by their acidity.

It is an object of the present invention to provide a lubricating oil additive which does not have the shortcomings of the prior art additives.

It is also an object of the present invention to provide lubricating oils containing the new additives and which oils have improved dispersing, detergent and anti-rust properties.

Another object of the present invention is the provision of a lubricating oil additive having improved properties over those of the prior art alkyl substituted carboxylic acid esters described, for example, in U.S. Pat. No. 3,381,022, and also with regard to the amide derivatives described in the U.S. Pat. No. 3,172,892.

Other objects of the invention will be apparent to those skilled in the art from the present description.

GENERAL DESCRIPTION OF THE INVENTION

The lubricating oil additives of the present invention comprise reaction products of an alcohol or hydroxyaromatic compound with a hydrocarbon chain substituted carboxylic acid, anhydride, chloride or ester, which hydrocarbon chain substituent is substantially saturated and contains at least 30, and preferably at least 50, carbon atoms, said resulting product being then neutralized with an ashless basic compound to provide in the final reaction product at least about 0.9% by weight of nitrogen. After an extensive research investigation it has been found that these additives impart improved detergency, dispersing and anti-rust properties to lubricating oils, fuel oils and carburants.

These novel additives and products of the invention are produced in the form of a complex mixture, rather than a precise chemical compound, of which it is difficult to determine the exact chemical composition and the relative proportions present of the various constituents. It is for this reason that the products must be described in terms of the process of manufacturing them. The presence of the ester grouping resulting from the reaction of the alcohol or hydroxyaromatic compound and the substituted carboxylic acid, anhydride, chloride or ester has been confirmed by infra-red analysis. The esterification reaction between the substituted carboxylic acid, anhydride, etc., acylating agent and the alcohol or hydroxyaromatic compound results in an equilibrium difficult to displace; the resulting product contains in solution a variable proportion of the unreacted acylating agent and, as a dispersion in said solution, unreacted alcohol or hydroxyaromatic compound. It is essential, in order to obtain good dispersing properties when employing the product as a lubricating oil additive, to neutralize completely the complex reaction mixture with an ashless basic nitrogen compound.

The content of this reaction mixture in residual acid compounds, acid and/or anhydride functional groups, is evaluated by methods conventional for each type of acylating agent. For example, a simple potentiometric titration may be concerned in the case when acylation agent is a monocarboxylic acid or a determination by infrared spectroscopy in the case where the acylation agent is a substituted cyclic anhydride, or any other suitable method taken separately or in combination may be employed.

In fact, the content of residual acid components must have a determined value if it is desired to obtain, after neutralization by an ashless basic compound, a product possessing good dispersing properties with regard to sludge. It has appeared more practical to express the content of residual acid components in terms of a minimal nitrogen content in the final product. This minimal nitrogen content, which determines the quantity of ashless basic nitrogen compound necessary for neutralizing the residual acid components (acid and/or anhydride functional groups) expresses the basicity degree to be introduced in the medium for obtaining a product having good dispersing power. This minimal content in nitrogen is about 0.9% by weight. It is comprised in the final complex mixture between about 0.9 and 2.5%. This amount is important if satisfactory results are to be obtained.

Consideration has been given to neutralizing the complex mixture by means of a metal base compound such as barium, magnesium or calcium oxides. However, the resulting final products, if they are good detergents possessing anti-rust properties, are poor dispersing agents. However, if the complex mixtures are neutralized, in accordance with the present invention, with an ashless basic nitrogen compound, such as an aminated compound, and among this class of compounds more especially polyamines, the resulting complex products are good dispersing agents, the anti-rust efficiency of which depends upon ester quantity present in the final compound.

It has been tried to reconstitute artificially the invention complex product by mixing a neutral ester and succinimide, but it has been found that the dispersing power was clearly lower and unsatisfactory. It is, therefore, obvious that the products of the invention are not simple mixtures of esters and succinimides.

Carboxylic acids substituted with a fairly saturated hydrocarbon chain containing at least 30 carbon atoms, and preferably at least about 50 carbon atoms, or their substituted derivatives such as anhydrides, acid chlorides, esters, are the preferred acylation agents of the present invention. They are prepared in reacting an ethylenically unsaturated carboxylic acid, or an anhydride, an halide, or an alkyl ester of the acid, with an unsaturated polyolefin or an halogenated polyolefin of high molecular weight, having at least about 30 carbon atoms, and preferably about 50 carbons, on the chain. Reaction consists only of heating the two bodies in reaction at a temperature comprised between 150° and 250°C. Those products, of high molecular weight, may contain polar substituted groups or lateral hydrocarbon substitution groups.

As the carboxylic acid moiety, ethylenically unsaturated carboxylic compounds, may be employed including monoacids, such as acrylic acid, methacrylic acid; diacids, such as maleic, fumaric, itaconic acids, their anhydrides or their chlorinated derivatives, ethylenic acids of $C_5$, $C_6$, etc. Succinic anhydride and succinic acid both substituted by a fairly saturated hydrocarbon group containing at least 50 carbon atoms, are the preferred acylation agents. They are easily obtained by reaction of maleic acid or anhydride with a polyolefin, such as polyethylene, polypropylene polybutylene, polyisobutylene, polypentene, etc., or a chlorinated polyolefin, such as chlorinated polypropylene. Those products have a molecular weight sufficient for reaching a condensation product of about 50 molecular units. Practically speaking, the molecular weight is at least about 700.

Suitable esterification agents for the substituted carboxylic acids defined hereinabove, may vary greatly. These may include aliphatic monoalcohols, such as methyl, ethyl, propyl, isopropyl, butyl, isobutyl, hexyl, heptyl, octyl, isooctyl, nonyl, decyl alcohols, fatty alcohols, etc.; aromatic or cycloaliphatic monoalcohols, such as benzyl alcohol, cyclohexanol, etc.; polyalcohols, such as ethylene glycol, propylene glycol, diethylene glycol, triethylene glycol, glycerol, trimethylolethane, trimethylolpropane, pentaerythritol, sorbitol, mannitol, etc.; and partially esterified esters of those polyols. It is also possible to use unsaturated alcohols, such as allyl alcohol, unsaturated polyols, substituted alcohols such as the amino-alcohols.

Hydroxyaromatic compounds, such as the phenolic compounds, may be employed to esterify the substituted carboxylic acid, anhydride, etc. These include phenol, the cresols, naphthols, alkylphenols, such as amylphenol, nonylphenol, dodecylphenol, halogenated phenols, diphenols, such as p,p'-dihydroxydiphenol, resorcinol, pyrocatechol, hydroquinone, diphenylolmethane, diphenylolpropane, etc.

Esterification, the time of which is comprised between 1 and 10 hours at a temperature of between about 50° and 300°C., preferably between about 100° to 200°C., may take place at atmospheric pressure, under pressure, at reduced pressure, or under nitrogen atmosphere, in the presence or in the absence of carrier solvent such as xylene, toluene, etc., this solvent facilitating both temperature control and water removal from the reaction mixture, by azeotrope formation. The esterification reaction may take place in the presence of a classical esterification catalyst, such as pyridine or its hydrochloride, sulfuric acid, para-toluene sulfonic acid and resins having a strongly or moderately acid character. It may also be achieved in the absence of any catalyst.

The relative proportions of the two constituents, alcohol or phenolic compound and aliphatic substituted carboxylic acid or anhydride, may vary within large limits. But in any event, since esterification is usually not complete, the remaining substituted acid or anhydride must afterwards be neutralized with an ashless basic nitrogen compound. Such neutralization is an important feature of the invention, as stated hereinabove, as it is necessary to obtain good dispersing properties. The unreacted alcohol or phenolic compound, finely dispersed in the product resulting from the esterification reaction, may be removed if it is in a substantial quantity. Otherwise it may remain in the product in a divided form without involving any disadvantage or incompatibility.

Suitable ashless basic compounds include ammonia, aliphatic, aromatic, or heterocyclic mono-amines, such as ethylamine, butylamine, aniline, pyridine, quinoline, etc., amines having polar groups, such as hydroxypropylene, nitroaniline, etc., alkylsubstituted amines, hydroxylated amines. Preferably polyamines shall be employed such as alkylidene diamines, triamines, tetramines, pentamines, hexamines; ethylene diamine, diethylene triamine, triethylene tetramine, tetraethylene pentamine, pentaethylene hexamine, polypropylene polyamide - polybutylene polyamines. Ureas, thioureas, hydrazines, cyanamides, etc., may be employed.

This neutralization is accomplished by heating the reaction mixture and ashless basic compound at a temperature of about 100° to 250°C. for a period of 1 to 6 hours, preferably 1 to 3 hours, under light vacuum, or by any other method known in the art of facilitating removal of water formed by a reaction. The molar ratio when a polyamine is employed and the residual acid compounds present in esterification mixture is desirably between about 0.25 and 2, preferably between 0.4 and 1.5.

The complex mixture resulting from neutralization is difficult to analyze. Therefore, the industrial new products obtained after this final stage, having excellent dispersing power, will be defined by their general process of manufacture.

DETAILED DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and through the specification, the quantities of material are expressed in terms of parts by weight, unless otherwise specified.

The acylation agent used in the Examples 1 through 12 was the reaction product of 350 grams of maleic anhydride with 2500 grams of a polyisobutene having a molecular weight equal to about 1000, heated at a temperature of between 190° and 240°C. for 10 hours. The resulting product is a polyisobutylene substituted-succinic anhydride.

EXAMPLE 1 a. 1258 grams of polyisobutylene substituted succinic anhydride, prepared as hereinabove, having a Pibsa index = 62.5 [Pibsa index (for polyisobutenylsuccinic anhydride) is the number of potash milligrams necessary to neutralize 1 gram of the product] were reacted with 11.9 grams of pentaerythritol for 3 hours, 50 minutes at a temperature of 140°–150°C., then for 2 hours at 180°–190°C.

b. 200 grams of the product prepared hereinabove in part a) were reacted with 6.8 grams of tetraethylenepentamine at a temperature of 155°C. for 2 hours under a partial vacuum (about 400 mm. Hg. pressure). The vacuum treatment was continued providing evaporation at a pressure of 20 mm. Hg. for 30 minutes. This vacuum treatment facilitated removal of water formed during the reaction. The resulting product had a nitrogen weight percentage of 1.21%.

EXAMPLE 2 a. 898 grams of polyisobutylene substituted-succinic anhydride, produced as hereinabove, having a Pibsa index = 62.5, were reacted with 12 grams of glycerol for 3 hours at a temperature of 150°C., followed by 3 hours at 190°C.

b. 300 grams of the product of part a) hereinabove were reacted with 9.6 grams of triethylenetetramine under the same reaction conditions as in Example 1*b*). Nitrogen weight percentage in the final product was 1.17%.

EXAMPLE 3 a. 1258 grams of polyisobutylene substituted-succinic anhydride, produced as hereinabove, having a Pibsa index = 62.5, were reacted with 19 grams of pentaerythritol for 4 hours at a temperature of 150°C., then for 2 hours at 190°C.

b. 150 grams of the product prepared in part a) were reacted with 4.9 grams of tetraethylenepentamine under the same reaction conditions as in Examples 1*b*). Nitrogen weight percentage of the final product was 1.11%.

EXAMPLE 4 a. 1796 grams of polyisobutylene substituted-succinic anhydride, produced as hereinabove, having a Pibsa index = 62.5, were reacted with 94 grams of phenol in the presence of 280 grams of xylene for 1.5 hours at a temperature of 160°C. Then 9 grams of p-toluene sulfonic acid were added and reaction continued for 2 hours at 160°C. Water formed during the reaction was removed by means of a Dean-Starck apparatus. Afterwards distillation was conducted under reduced pressure (20 mm. Hg.) for 1 hour at 160°C.

b. 200 grams of the product prepared in part a) were reacted with 6 grams of tetraethylene pentamine under the reaction conditions of Example 1*b*). Nitrogen weight percentage of the final product was 1.08%.

EXAMPLE 5 a. 898 grams of polyisobutylene substituted-succinic anhydride, produced as hereinabove, having a Pibsa index = 56, were reacted with 94 grams of phenol in the presence of 150 grams of xylene for 2 hours at a temperature of 160°C. Then 5 grams of p-toluene sulfonic acid were added and reaction continued for another hour at 160°C. Water formed during the reaction was removed by means of a Dean-Starck apparatus. Reaction was concluded under reduced pressure (20 mm. Hg.) for 1.5 hours at 160°C.

b. 200 grams of the product prepared in part a) were reacted with 6.8 grams of triethylenetetramine under the same reaction conditions as in Example 1*b*). Nitrogen weight percentage of the final product was 1.25%.

EXAMPLE 6

200 grams of the product prepared in Example 4, part a), were reacted with 8.81 grams of tetraethylenepentamine under the same reaction conditions as in Example 1*b*). Nitrogen weight percentage in the final product was 1.55%.

EXAMPLE 7

2 kilograms of polyisobutylene substituted-succinic anhydride, prepared as hereinabove [Pibsa index = 53] were reacted with 107 grams of diphenylol propane in the presence of 21 grams of p-toluenesulfonic acid catalyst for 4 hours at a temperature of 160°C. The product was then vaporized under vacuum at 160°C. for 1 hour, and neutralized with 82 grams of tetraethylenepentamine at 155°C. for 2 hours, under a partial vacuum (400 mm. Hg. pressure, approximately). This treatment was followed with a vaporization at 20 mm. Hg. pressure for 30 minutes. Nitrogen content in the final product was 1.29%.

EXAMPLE 8

62.5 grams of diphenylolpropane were heated at 170°C. 484 grams of polyisobutylene substituted-succinic acid prepared as hereinabove (Pibsa Index = 63.5) were introduced over 15 minutes at 170°C. under 400 mm. Hg. pressure. The reaction proceeded for 4 hours (170°C. under partial vacuum). 543 grams of the resulting product were treated afterwards with 21.5 grams of tetraethylenepentamine under the same conditions as in Example 7. Nitrogen content in final product was 1.40%.

EXAMPLE 9

64 grams of diphenylolpropane were heated in the presence of 472 grams of xylene at 110°–115°C. Then 1257 grams of polyisobutylene substituted-succinic anhydride prepared as hereinabove, (Pibsa Index = 62.5), were introduced over a period of 25 minutes. After 1 hour of reaction at 110°–115°C., 13.2 grams of pyridine were added. A second addition of an equal amount of pyridine was made after 2 hours of reaction. After 3.5 hours of reaction, the product is vapourized at 140°C. under 20 mm. Hg. pressure for 30 minutes.

EXAMPLE 10

200 grams of the product of Example 9 were neutralized with 5.6 grams of tetraethylenepentamine under the same conditions as in Example 7. Nitrogen content of the final product was 1%.

EXAMPLE 11

200 grams of the product of Example 9 were neutralized with 7.7 grams of triethylenetetramine under the same conditions as in Example 7. Nitrogen content of the final product was 1.42%

EXAMPLE 12

6640 grams of polyisobutylene substituted-succinic anhydride (Pibsa Index = 76.3) were reacted with 465 grams of diphenylolpropane in the presence of 53 grams of para-toluene sulfonic acid for 2.5 hours at 162.5°C. Then the product was vapourized under vacuum for 1.5 hours. 667 grams of the resulting product were neutralized with 23.1 grams of tetraethylenepentamine under the same conditions as in Example 7. Nitrogen content of the final product obtained in this way was 1.23%.

EXAMPLE 13

The acylating agent employed in this example was the reaction product of maleic anhydride with a polyisobutene having a molecular weight equal to about 455, heated at a temperature between 190° and 240°C. for 10 hours.

200 grams of the resulting polyisobutylene substituted-succinic anhydride (Pibsa Index = 81) were reacted with 16.46 grams of diphenylolpropane and 2.1 grams of p-toluene-sulfonic acid over 4 hours at 170°C. and for 30 minutes under vacuum at 170°C. 201 grams of the resulting product were reacted with 9 grams of tetraethylenepentamine at 155°C. for 2 hours under partial vacuum (about 400 mm. Hg. pressure). Treatment was completed under vacuum of 20 mm. Hg. pressure for 30 minutes. Nitrogen content of the final product was 1.44%.

The acylation agent used in Examples 14 and 15 below, was the reaction product of acrylic acid with a chlorinated polyisobutene, heated at temperature of 180°–190°C. during 10 hours. The obtained chlorinated polyisobutenylpropionic acid had an acid index of 31 potash milligrams per gram.

EXAMPLE 14 a. 138 grams of chlorinated polyisobutenylpropionic acid, prepared as hereinabove, were reacted at a temperature of 140°C. with 2.13 grams of pentaerythritol in the presence of 150 grams of xylene and 1.4 grams of paratoluene-sulfonic acid. The reaction was ended when the stoichiometric amount of water was collected. The unreacted pentaerythritol was removed by filtration. The remaining mixture was treated in a rotary evaporator at 130°C. under reduced pressure of 1 mm. Hg. for 30 minutes. The final product had an acid index of 17.25 potash milligrams per gram.

b. 110 grams of the product obtained in part a) were reacted with 4.3 grams of tetraethylene pentamine in 50 grams heptane for 1.5 hours at 150°C. The product was then filtered and evaporated at 120°C. under 5 mm. Hg. for 30 minutes. Nitrogen weight percentage in the final product was 1.35%.

EXAMPLE 15 a. 200 grams of chlorinated polyisobutenylpropionic acid, produced as hereinabove, were reacted with 10.38 grams of diphenylolpropane in the presence of 150 grams of xylene and 2.1 grams of para-toluene sulfonic acid in accordance with the reaction conditions of Example 14*a*).

b. 142 grams of the product prepared in part a) were reacted with 6.4 grams of tetraethylenepentamine in 50 grams of heptane in accordance with the reaction conditions of Example 14*b*). Nitrogen weight percentage in the final product was 1.43%.

It will be apparent that in the foregoing examples other polyolefin substituted-acid anhydrides, -carboxylic acids, -acid halides, -esters, and the like may be employed, such as polyethylene-, polypropylene- or polypentene-substituted-acid anhydrides, carboxylic acids, acid halides and esters. Other alcohols or hydroxy-aromatic compounds may be employed such as those listed hereinabove in the present specification. Similarly, other ashless or organic bases may be employed, including those listed hereinabove in the present specification.

The additive products of the present invention, including the products of the foregoing examples, are desirably employed in lubricating oils, fuel oils and carburants, in amounts of between about 0.01% and 10%, preferably between about 0.1% and 3%, by weight of final product.

The foregoing products according to the present invention have been tested with regard to anti-rust and dispersing properties in lubricants.

The tests of the dispersing power were conducted according to the stain or spot method described in Volume 1 of A. Schilling's book "Les huiles pour moteurs et le graissage des moteurs" (Oils for motors and motor greasing), edition of 1962, pages 89–90. Stains or spots were achieved with the additive dissolved in a lubricating oil of SAE 30. Sludge was added in order to obtain a content of carbonaceous substances of 0.36%. There are five stains or spots obtained:

1. after heating at 200°C. for 10 minutes
2. after heating at 250°C. for 10 minutes
3. after heating at 200°C. for 10 minutes (at the outset 1% of water was added)
4. after heating at 200°C. during 1 minute (initially 1% of water was added)
5. After adding of 1% of water, in the cold state Readings were made after 48 hours. For every stain or spot, the dispersed sludge percentage is expressed with regard to the oil stain and calculated from the respective diameters. The higher the percentages of dispersed product; the better is the dispersion with regard to sludge.

For the products of the foregoing examples the following values were obtained:

Example 1 product = 308
Example 2 product = 304
Example 3 product = 312
Example 4 product = 306
Example 5 product = 303
Example 6 product = 308
Example 7 product = 308
Example 8 product = 306
Example 10 product = 301
Example 11 product = 312
Example 14 product = 298

Example 15 product = 308

A comparison was made of the dispersing values obtained by the same test method with other products such as a non-neutralized ester and prior art products commonly used, considered as typical of the present state of the art. Listed below are the values obtained:

| | |
|---|---|
| Product of Example 9 (non-neutralized product | < 200 |
| Monosuccinimide (Product of Comparative Example 16, below) | 268 |
| Bis-succinimide (Product of Comparative Example 17, below) | 274 |
| Ester of substituted succinic acid and pentaerythritol (Comparative Example 18, below) | 265 |
| Ester of substituted succinic acid and glycerol (Comparative Example 19, below) | 250 |
| Ester of substituted succinic acid and phenol (Comparative Example 20, below) | < 200 |
| Polyisobutenylpropionamide (Comparative Example 21, below) | 263 |

The mono and bis-succinimides and polyisobutenylpropionamide were tested, on the basis of the same nitrogen content as the products of Examples 1 through 8, 10, 11, 14 and 15 (reference: 1% monosuccinimide in SAE 30 oil).

The various prior art succinimide esters listed in the above table were synthesized according to classical esterification processes described hereinbelow and tested, for the same weight as the products of Examples 1 through 8, 10, 11, 14 and 15 (1.8% in SAE 30 oil).

COMPARATIVE EXAMPLE 16 — MONOSUCCINIMIDE PREPARATION 250 grams of polyisobutylene substituted-succinic anhydride having a Pibsa index = 53 were reacted with 18 grams of tetraethylenepentamine at 155°C. for 2 hours, under partial vacuum (about 400 mm. Hg. pressure). Treatment was followed with a vapourization under 20 mm. Hg. pressure for 30 minutes. Nitrogen content of the final product was 2.46%.

COMPARATIVE EXAMPLE 17 — BIS-SUCCINIMIDE PREPARATION

250 Grams of polyisobutylene substituted-succinic anhydride having a Pibsa index = 55 were reacted with 8.6 grams of triethylenetetramine at 155°C. for 2 hours, under a partial vacuum (about 400 mm. Hg. pressure). Treatment was followed by a vapourization under 20 mm. Hg. pressure for 30 minutes. Nitrogen content of the final product was 1.32%.

COMPARATIVE EXAMPLE 18—PREPARATION OF SUBSTITUTED SUCCINIC ACID AND PENTAERYTHRITOL ESTER 1258 grams of polyisobutylene substituted-succinic anhydride (Pibsa index = 62.5) were reacted with 94 grams of pentaerythritol for 3.5 hours at 135°–145°C. then for 2 hours at 175°–185°C. Unreacted pentaerythritol was removed by filtration. The filtrate constituted ester.

COMPARATIVE EXAMPLE 19—PREPARATION OF GLYCEROL AND SUBSTITUTED SUCCINIC ANHYDRIDE ESTER 898 grams of polyisobutylene substituted-succinic anhydride with a Pibsa Index = 62.5 were reacted with 46 grams of glycerol for 3 hours at 150°C., then for 3 hours at 190°C. The reaction product was the desired ester.

COMPARATIVE EXAMPLE 20—PREPARATION OF PHENOL AND SUBSTITUTED SUCCINIC ACID ESTER 898 grams of polyisobutylene substituted-succinic anhydride with a Pibsa index = 62.5 were reacted with 376 grams of phenol in the presence of 190 grams of xylene for 1 hour at 160°–165°C. Afterwards 12.7 grams of p-toluene sulfonic acid were added. The reaction proceeded for 30 minutes at 160°–165°C. This operation was repeated twice. Finally, xylene, residual phenol and catalyst were removed under vacuum (160°–165°C. during 30 minutes — 10 to 20 mm. Hg. pressure). The final product was the ester.

COMPARATIVE EXAMPLE 21 — POLYISOBUTENYLPROPIONAMIDE 200 grams of polyisobutenylpropionic acid were reacted with 14.55 grams of tetraethylenepentamine in 200 grams of heptane at 160°C. under reflux for 3 hours. After cooling, 100 grams of heptane were added. The mixture was filtered. Heptane was eliminated at 120°C. under 1 mm. Hg. with a rotary evaporator. Nitrogen content of final product was 2.32%.

As will be shown below, residual acidity in the lubrication additives of the present invention must be reduced to a minimum, otherwise poor dispersion qualities will result. It has been discovered that sufficient ashless basic compound must be introduced into the product after esterification to impart a nitrogen content of at least about 0.9% in the additive product. For the demonstration which follows there was synthesized a range of products representing various quantities of free acidity in the reaction product at the end of the esterification reaction. Various molar ratios of substituted carboxylic acid or anhydride with respect to hydroxy compound were employed as well as various quantities of catalyst and various ratios of the ashless basic compound.

In the tables hereinbelow, residual acidity is represented by free anhydride groups, the same as by groups of free acids. The estimation of this acidity was made in the cases which follow by determination of free anhydride function by means of infrared spectroscopy. First case: ester based on substituted succinic anhydride and pentaerythritol.

| Weight percentage of free anhydride neutralized by tetraethylene pentamine | Weight percentage of corresponding nitrogen in the final complex mixture | Spot test value |
|---|---|---|
| 0 | 0 | 265 |
| 6 | 0.27 | < 200 |
| 24 | 0.82 | < 200 |
| 30 | 1 | 295 |
| 35 | 1.11 | 312 |
| 47 | 1.56 | 303 |
| 54 | 1.65 | 305 |
| 65 | 2.11 | 309 |

As is seen from the above table, a minimal basicity degree of 0.9% of nitrogen, in the neutralized mixture is necessary to provide good dispersion. This corresponds to a weight percentage of about 30% of residual acid compounds in the mixture resulting from esterification before neutralization. Second case: ester based on substituted succinic anhydride and phenol.

| Weight percentage of free anhydride neutralized by triethylenetetramine or tetraethylene pentamine with different molar ratios amine/anhydride | Weight percentage of corresponding nitrogen in the final complex mixture | Spot test value |
|---|---|---|
| 47 | 0.71 | 265 |
| 47 | 0.88 | 273 |
| 47 | 1.26 | 303 |
| 47 | 1.56 | 308 |

Third case: ester based on polyisobutenylpropionic acid and pentaerythritol.

| Weight percentage of free acid neutralized by tetraethylenepentamine | Weight percentage of corresponding nitrogen in the final complex mixture | Spot test value |
|---|---|---|
| 40 | 0.85 | 269 |
| 65 | 1.35 | 308 |

As is shown, it is necessary to have a nitrogen percentage of at least 0.9% by weight in the final complex mixture to obtain good dispersing properties.

Finally, for comparison purposes, spot test values achieved with products produced artificially by mixing a neutral ester with a succinimide, a bis-succinimide or a propionamide will be shown below. Numbers 0 — 20 — 50 — 80 — 100 express weight percentages in mixture.

| Mono-succinimide | Ester of neutral pentaerythritol and substituted succinic anhydride 0 | 20 | 50 | 80 | 100 |
|---|---|---|---|---|---|
| 100 | 270 | | | | |
| 80 | | 293 | | | |
| 50 | | | 270 | | |
| 20 | | | | 221 | |
| 0 | | | | | 265 |

| Bis-succinimide | Ester of neutral pentaerythritol and substituted succinic anhydride 0 | 20 | 50 | 80 | 100 |
|---|---|---|---|---|---|
| 100 | 280 | | | | |
| 80 | | 259 | | | |
| 50 | | | 216 | | |
| 20 | | | | 227 | |
| 0 | | | | | 265 |

Equal parts by weight of ester of pentaerythritol and polyisobutenylpropionic acid and polyisobutenylpropionamide gave a spot test value of 270.

The numbers which are to be compared specially with the ones of Examples 1, 3, 6, 7 and 11 show the superiority of dispersion characteristics of the products according to the invention, which are 308 or 312.

The anti-rust characteristics of the products according to the invention have been tested in the laboratory with favorable results. The general tendency has been confirmed by motor tests (sequence II B, gasoline motor V-8 of a 1967 Oldsmobile). The basic information to which the additive was added was composed of a calcium sulfonate, a calcium phenate and a zinc dithiophosphate. The following values expressing average engine rust (AER), were obtained (ideal value 10):

Basic formula plus Example 7 product — AER 8.6

Basic formula plus Example 11 product — AER 7.9

As a comparison of the prior art, the following value was obtained:

Basic formula plus bis-succinimide — AER 7.2

The entirety of the test results set forth hereinabove shows quite well the important improvement provided by the additives for lubricating oils produced according to the invention and characterizes the technical progress that such new products have achieved.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An additive comprising the reaction product of a hydroxyl compound with a member selected from the class consisting of hydrocarbon chain and chlorinated polyolefin -substituted carboxylic compounds, wherein said hydroxyl compound is a member selected from the class consisting of aliphatic, cycloaliphatic mono- and poly-alcohols and phenolic compounds, wherein said hydrocarbon chain and said chlorinated polyolefin substituent are substantially saturated and contain at least about 30 carbon atoms, which reaction product is neutralized wholly with an ashless basic nitrogen compound selected from the class of aromatic and aliphatic mono-amines, alkylene poly-amines, and ammonia, the residual acidity of said reaction product being such that its total neutralization is accomplished by the addition of sufficient ashless basic nitrogen compound to impart a nitrogen content of between about 0.9% and 2.5% by weight of the final product.

2. An additive in accordance with claim 1 wherein the hydrocarbon chain and chlorinated polyolefin substituent is a substantially unsaturated aliphatic substituent containing at least about 50 carbon atoms.

3. An additive in accordance with claim 1, wherein the hydrocarbon chain and chlorinated polyolefin substituted carboxylic compound is a member selected from the class consisting of hydrocarbon substituted mono- and poly-carboxylic acids, anhydrides, halides and esters thereof.

4. An additive in accordance with claim 1, wherein the reaction between the hydroxyl compound and the hydrocarbon chain and chlorinated polyolefin substituted carboxylic compound is conducted at a temperature of between about 100 and 200°C. for a period of between about 1 and 10 hours.

5. An additive in accordance with claim 1, wherein the residual acid components present after the reaction between the hydroxyl compound and the hydrocarbon chain and chlorinated polyolefin substituted carboxylic compound and the ashless basic nitrogen compound added to neutralize them shall have a molar ratio of base to acid of between about 0.25 and 2.

6. An additive in accordance with claim 1, wherein the ashless basic nitrogen compound is a polyalkylene polyamine.

7. An additive in accordance with claim 1, wherein the hydrocarbon substituent is a polyolefin radical.

* * * * *